US005299997A

United States Patent [19]

Chen

[11] Patent Number: 5,299,997

[45] Date of Patent: Apr. 5, 1994

[54] HORSE-RIDING TYPE EXERCISER

[76] Inventor: Paul Chen, No. 3-6, Ching Yang Rd., Liu Pao Village, Ta Ya Hsiang, Taichung Hsien, Taiwan

[21] Appl. No.: 111,101

[22] Filed: Aug. 24, 1993

[51] Int. Cl.[5] ..... A63B 69/06; A63B 21/068

[52] U.S. Cl. ..... 482/96; 482/72

[58] Field of Search ..... 482/51, 57, 95, 96, 482/111, 72, 148; 472/106, 110

[56] References Cited

U.S. PATENT DOCUMENTS

| | | | |
|---|---|---|---|
| 2,642,288 | 6/1953 | Bell | 482/96 |
| 4,300,760 | 11/1981 | Bobroft | 482/96 |
| 4,743,010 | 5/1988 | Geraci | 482/95 |
| 5,156,650 | 10/1992 | Bals | 482/95 |

FOREIGN PATENT DOCUMENTS

| | | | |
|---|---|---|---|
| 21105486 | 6/1983 | United Kingdom | 482/96 |

*Primary Examiner*—Stephen R. Crow
*Attorney, Agent, or Firm*—Woodcock Washburn Kurtz Mackiewicz & Norris

[57] ABSTRACT

An exerciser includes a base frame having first and second ends and including two parallel beams, a foot post, a seat post, and a supporting member. An axle is rotationally mounted to the first end of the base frame between the parallel beams. Each beam includes a track adjacent to the second end of the base frame. The foot post has a lower end securely mounted to the axle to pivot therewith and an upper end to which a pair of foot rests are provided. A fixed beam extends outwardly from the foot post toward to the second end of base frame and has a distal end. The seat post includes a lower end securely attached to the axle to pivot therewith and an upper end for mounting a seat thereon. A mediate section of the supporting member is pivoted at an underside thereof to the distal end of the fixed beam, while an upper side of the mediate section of the supporting member is in pivotal connection with the seat post to allow pivotal movements therebetween. A pair of handgrips are mounted on a top section of the supporting member. A rod is mounted to a bottom section of the supporting member and has two ends. A roller is rotationally mounted to each end of the rod and is movably received in an associated track in each beam.

4 Claims, 5 Drawing Sheets

HORSE-RIDING TYPE EXERCISER

BACKGROUND OF THE INVENTION

1. Field of the Invention

The present invention relates to an exerciser which provides an exercise similar to horse riding.

2. Description of related art

Various types of exercisers have been developed, such as simple hand exercisers, leg exercisers, and multi-function exercisers having resistance means, allowing the user to exercise different muscles of his body. The present invention provides a particular exerciser in which the user may have a feeling like horse-riding.

SUMMARY OF THE INVENTION

A horse-riding type exerciser provided by the present invention generally includes a base frame having two parallel beams, a foot post means, a seat post means, and a supporting means for supporting the seat post means and the user.

An axle is rotationally mounted to a front section of the base frame between the parallel beams. The seat post means includes two members each with a lower end securely attached to the axle to pivot therewith. The upper sections of the members are substantially horizontal for mounting a seat thereon.

The foot post means has a lower end securely mounted to the axle to pivot therewith and an upper end from which a rod extends laterally, a pair of foot rests being mounted on the rod. Furthermore, a fixed beam extends outwardly from the foot post means toward to rear end of the base frame and in a direction substantially perpendicular to the extending direction of the rod.

A mediate section of the supporting means is pivoted at an underside thereof to the distal end of the fixed beam. Mounted on an upper side of the mediate section of the supporting means is a socket which extends between the members and through which a pin is mounted, allowing pivotal movements of the socket about the pin. A pair of handgrips are mounted on top section of the supporting means. A second rod is mounted to a bottom section of the supporting means and has a roller rotationally mounted to each of two ends thereof. Each of the beams includes a track at a rear section thereof to receive and guide an associated roller. Preferably, a bumping member is provided to the rear end of the track to reduce the impact by the rollers.

Preferably, the supporting means includes a lower part and an upper part adjustably received in the lower part, thereby being suitable to users of different arm lengths.

When in use, at first, the user "mounts" the seat, with two feet on the foot rests, and with two hands holding the handgrips. Thereafter, the user may "stand" up by applying a force by his feet against the foot rests as well as applying an upward force on the handgrips. Accordingly, the seat post means and the foot post means pivot about the axis of axle toward the front end of the base frame and the supporting means pivots about its pivot point, while the rollers of the supporting means move along the tracks. Then, the user may relax to allow the elements to return (by the weight of the rider) back to their original positions. Continuous motions may allow the user to have a feeling like riding on a horse.

Other objects, advantages, and novel features of the invention will become more apparent from the following detailed description when taken in conjunction with the accompanying drawings.

DESCRIPTION OF THE PREFERRED EMBODIMENT

Figure 1:
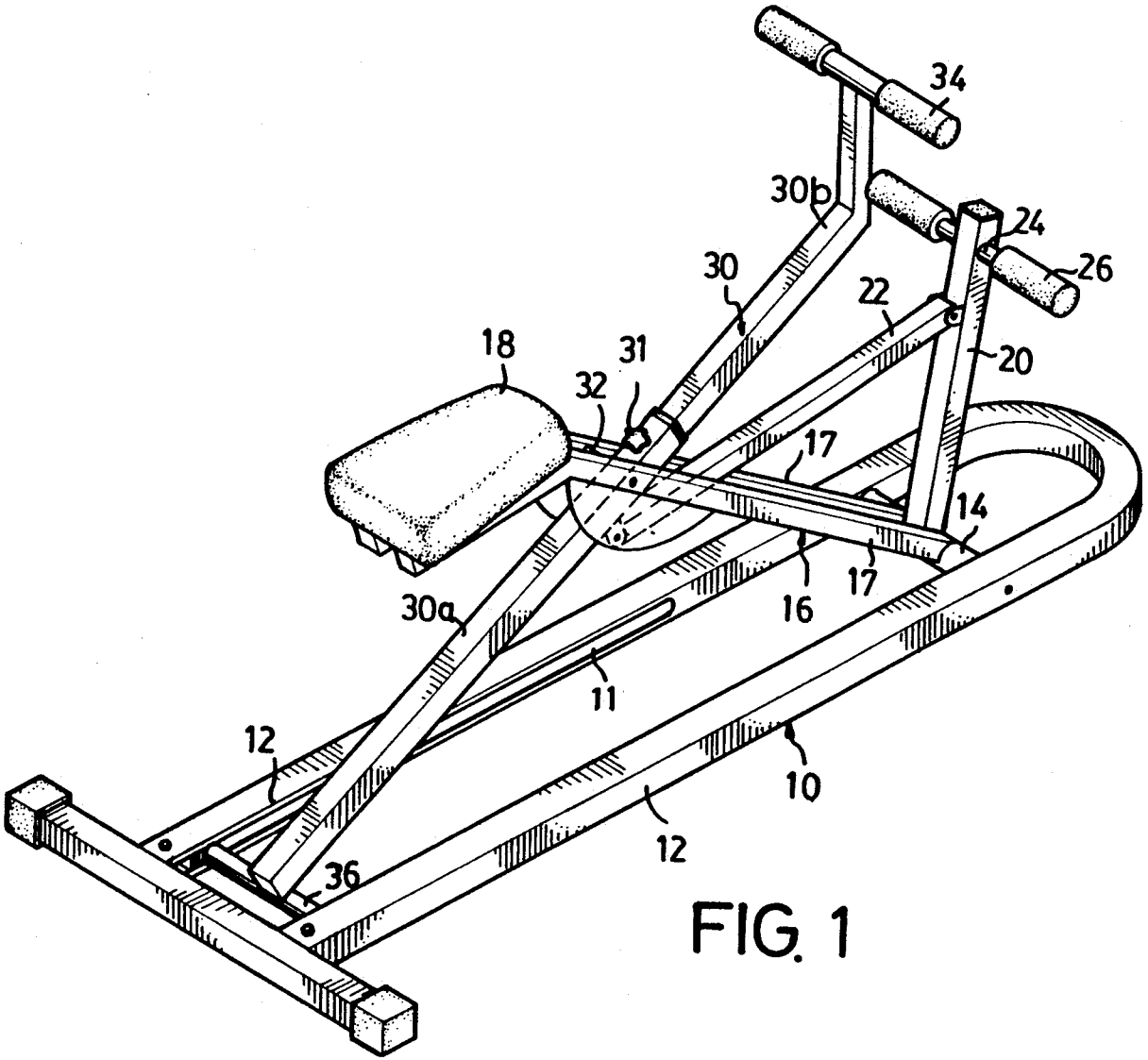
FIG. 1 is a perspective view of a horse-riding type exerciser in accordance with the present invention.
Figure 2:
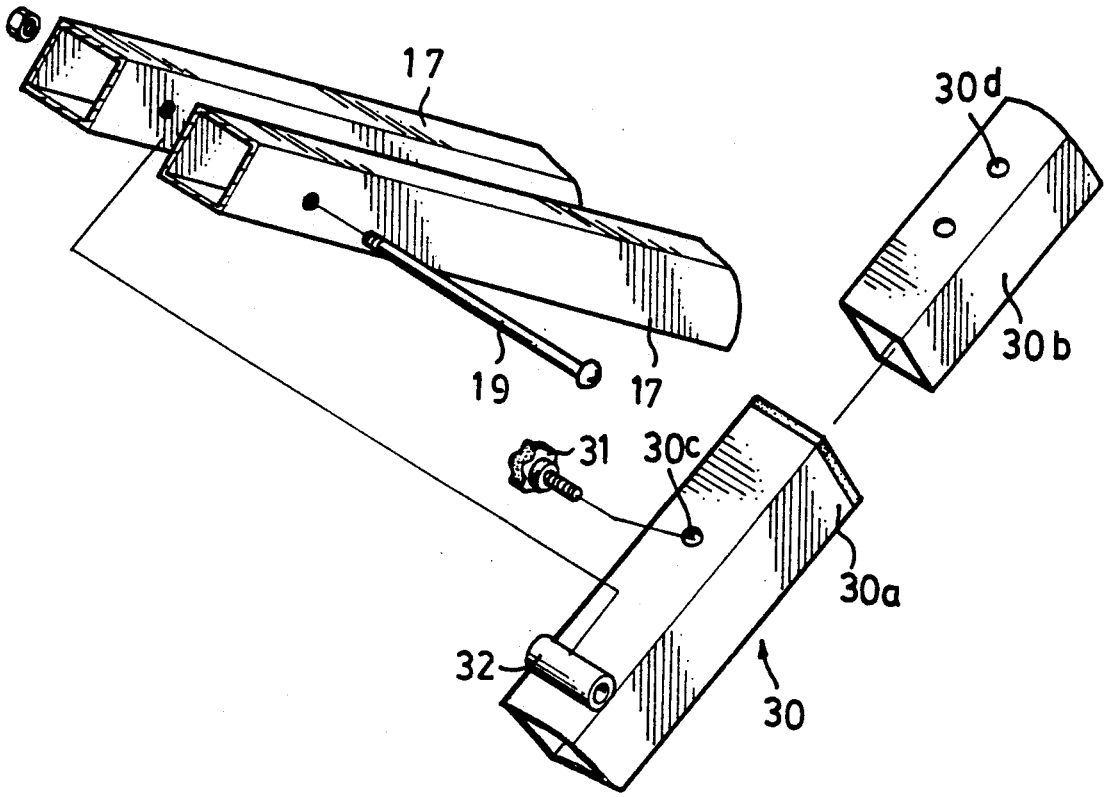
FIG. 2 is a partial exploded view illustrating the supporting means and the seat post means.

Referring to the drawings and initially to FIGS. 1 and 2, a horse-riding type exerciser in accordance with the present invention generally includes a base frame 10 having two parallel beams 12, a foot post means 20 pivotally mounted to the base frame 10, a seat post means 16 also pivotally mounted to the base frame 10, and a supporting means 30 for supporting the seat post means 16 and the user.

An axle 14 is rotationally mounted to a front section of the base frame 10 between the parallel beams 12. The seat post means 16 includes two members 17 each with a lower end securely attached to the axle 14 to pivot therewith. The upper sections of the members 17 are substantially horizontal for mounting a seat 18 thereon.

The foot post means 20 has a lower end securely mounted to the axle 14 to pivot therewith and an upper end from which a rod 24 extends laterally, a pair of foot rests 26 being mounted on the rod 24. Furthermore, a pivotably fixed beam 22 extends outwardly from the foot post means 20 toward to rear end of the base frame 10 and in a direction substantially perpendicular to the extending direction of the rod 24.

Figure 4:
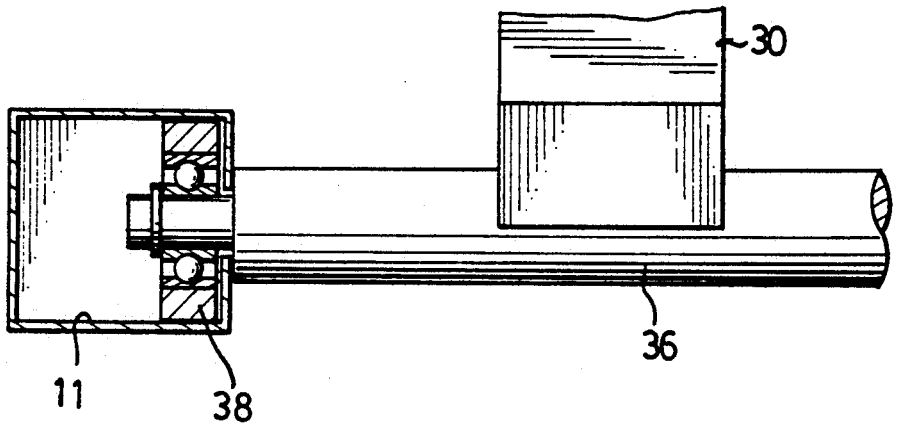
FIG. 4 is a cutaway view, partly sectioned, showing the roller structure.

A mediate section of the supporting means 30 is pivoted at an underside thereof to the distal end of the fixed beam 22. Mounted on an upper side of the mediate section of the supporting means 30 is a socket 32 which extends between the members 17 and through which a pin 19 (see FIG. 2) is mounted, allowing relative pivotal movement of the socket 32 about the pin 19, i.e., the supporting means 30 and the seat post 16 are pivotable relative to each other. A pair of handgrips 34 are mounted on another rod (not labelled) which in turn is mounted on top section of the supporting means 30. Referring to FIGS. 1 and 4, a rod 36 is mounted to a bottom section of the supporting means 30 and has a roller 38 rotationally mounted to each of two ends thereof. Each of the beams 12 includes a track 11 at a rear section thereof to receive an associated roller 38, which will be explained later. Preferably, a bumping member 13 is provided to the rear end of the track 11 to reduce the impact by the rollers 38. As to the front end of the track 11, since the velocity of the rollers 38, when approaching the front end, is relatively low, the bumping member can be omitted.

Figure 3:
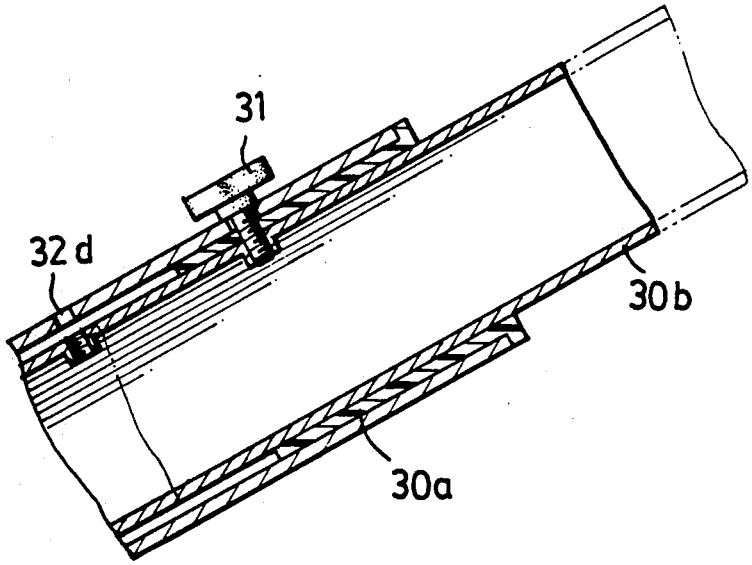
FIG. 3 is a partial cross-sectional view illustrating the adjustment of the supporting means.

Referring to FIGS. 2 and 3, preferably, the supporting means 30 includes a lower part **30*a* and an upper part 30*b* adjustably received in the lower part 30*a* and retained by a knob 31 passing through a hole 30*c* in the lower part 30*a* and one of a plurality of screw holes 30*d* in the upper part 30*b*, thereby being suitable to users of different arm lengths. Furthermore, the force required to operate the exerciser varies as the arm of force (from the handgrips 34 to the pivoted point of the lower part 30***a*) changes when the position of the upper part 30*b* relative to the lower part 30*a* changes, providing an effect similar to the variable resistance means used in conventional exercisers.

Figure 5:
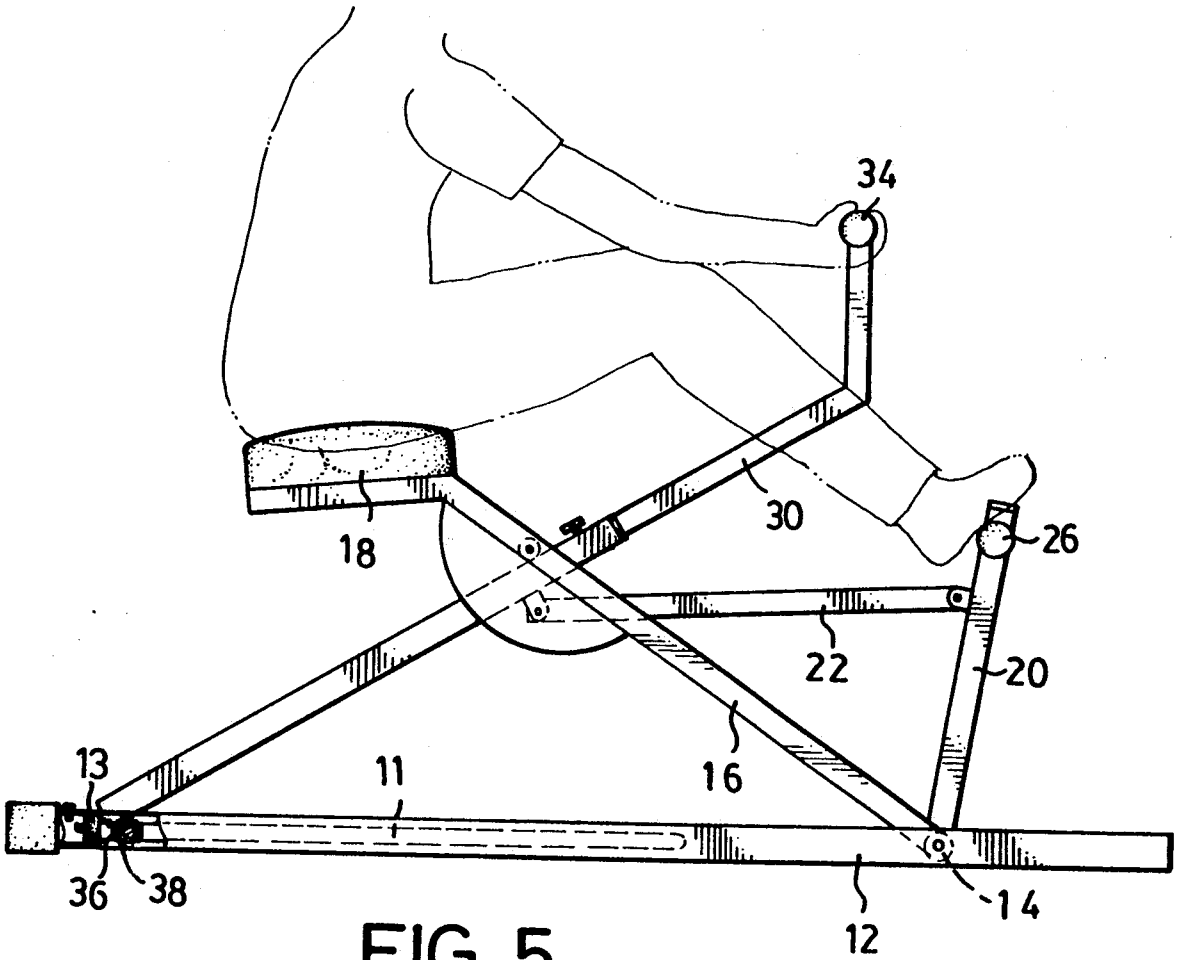
FIGS. 5 and 6 are schematic side views illustrating operation of the horse-riding type exerciser.
Figure 6:
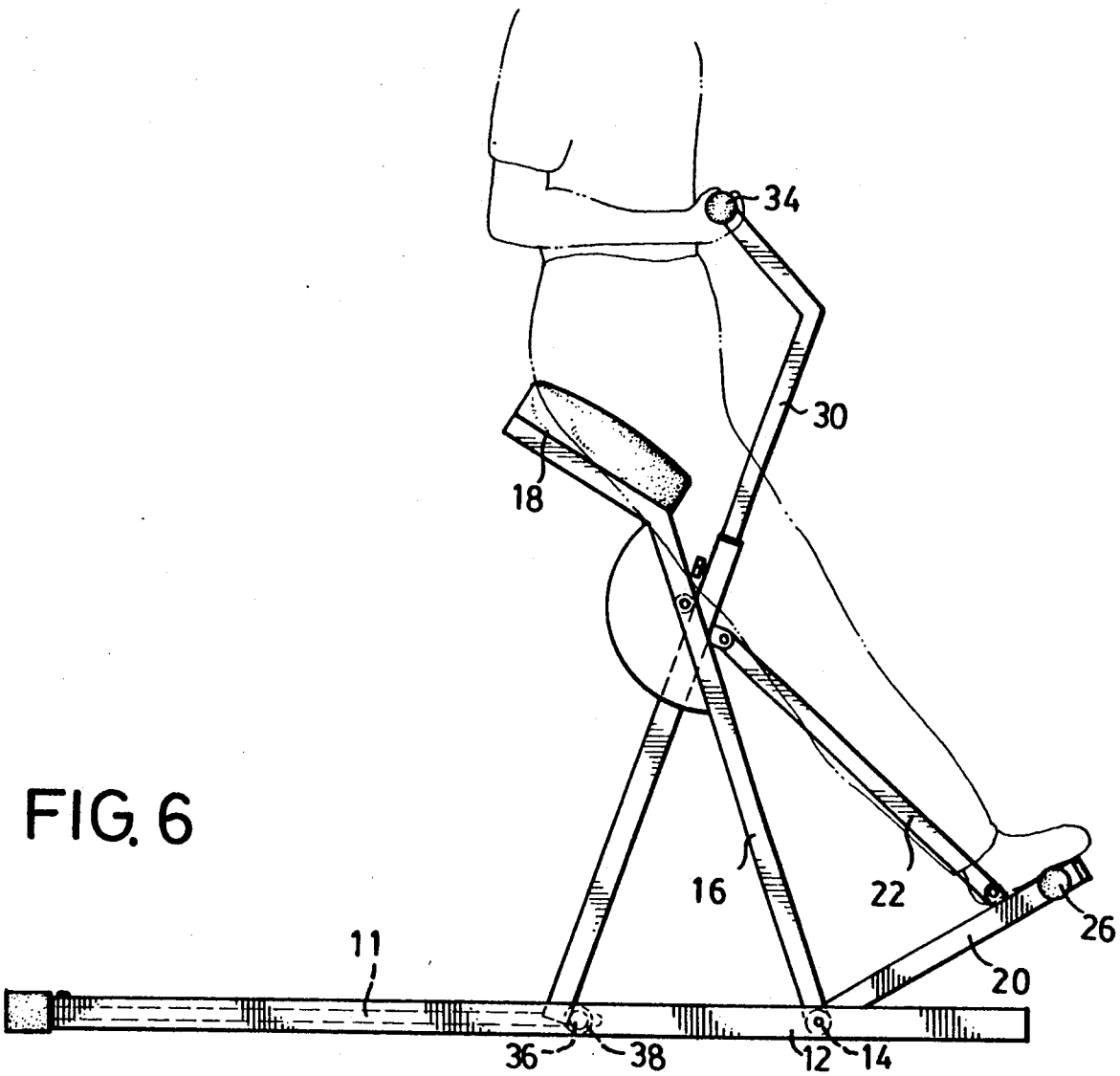

Referring now to FIG. 5, when in use, at first, the user "rides" on the seat 18, with two feet on the foot rests 26, and with two hands holding the handgrips 34 in a manner shown in this figure. Thereafter, the user may "stand" up by applying a force by his feet against the foot rests 26 as well as applying an upward force on the handgrips 34. Accordingly, the seat post means 16 and the foot post means 20 pivot clockwise about the axis of axle 14 (see FIG. 6) and the supporting means 30 pivots about its pivot point, while the rollers 38 of the supporting means 30 move rightward along the tracks 11 to a status shown in FIG. 6. Then, the user may relax to allow the elements to return (by the weight of the rider) back to their original positions shown in FIG. 5. Continuous motions may allow the user to have a feeling like riding on a horse.

Although the invention has been explained in relation to its preferred embodiment, it is to be understood that many other possible modifications and variations can be made without departing from the spirit and scope of the invention as hereinafter claimed.

I claim:

1. An exerciser comprising:

a base frame having first and second ends and including two parallel beams, an axle being rotationally mounted to said first end of said base frame between said parallel beams, each said beam including a track adjacent to said second end of said base frame;

a foot post means having a lower end securely mounted to said axle to pivot therewith and an upper end, a pair of foot rests being provided to said upper end of said foot post means, a pivotably fixed beam extending outwardly from the foot post means toward said second end of said base frame and having a distal end;

a seat post means including a lower end securely attached to said axle to pivot therewith and an upper end for mounting a seat thereon; and a supporting means for supporting the seat post means and the user, a mediate section of the supporting means being pivoted at an underside thereof to said distal end of said fixed beam, an upper side of said mediate section of said supporting means being in pivotal connection with said seat post means to allow pivotal movements therebetween, a pair of handgrips being mounted on a top section of said supporting means, a rod being mounted to a bottom section of said supporting means and having two ends, a roller being rotationally mounted to each said ends thereof and being movably received in associated said track in each said beam.

2. The exerciser as claimed in claim 1 wherein the seat post means includes a pair of members each having a lower end securely attached to said axle, a socket being mounted on an upper side of said mediate section of said supporting means and extending between said members and through which a pin is mounted to allow pivotal movement of said socket about said pin.

3. The exerciser as claimed in claim 1 further comprising a bumping member provided to a rear end of each said track.

4. The exerciser as claimed in claim 1 wherein said supporting means includes a lower part and an upper part adjustably received in the lower part.

* * * * *